US010561171B2

(12) United States Patent
Kartashov

(10) Patent No.: US 10,561,171 B2
(45) Date of Patent: Feb. 18, 2020

(54) PORTABLE SMOKING AND VAPORIZING DEVICE ASSEMBLY

(71) Applicant: Vladimir Kartashov, Washington, DC (US)

(72) Inventor: Vladimir Kartashov, Washington, DC (US)

(73) Assignee: JTLabs, LLC, Lewes, DE (US)

( * ) Notice: Subject to any disclaimer, the term of this patent is extended or adjusted under 35 U.S.C. 154(b) by 289 days.

(21) Appl. No.: 15/792,494

(22) Filed: Oct. 24, 2017

(65) Prior Publication Data

US 2018/0110259 A1 Apr. 26, 2018

Related U.S. Application Data

(60) Provisional application No. 62/411,835, filed on Oct. 24, 2016.

(51) Int. Cl.

| | |
|---|---|
| ***A24F 1/06*** | (2006.01) |
| ***A24F 47/00*** | (2006.01) |
| ***A24F 1/28*** | (2006.01) |
| ***A24F 1/22*** | (2006.01) |

(52) U.S. Cl.

CPC ..... *A24F 1/06* (2013.01); *A24F 1/22* (2013.01); *A24F 1/28* (2013.01); *A24F 47/002* (2013.01)

(58) Field of Classification Search

CPC ..... A24F 1/06; A24F 1/22

See application file for complete search history.

(56) References Cited

U.S. PATENT DOCUMENTS

| | | | | |
|---|---|---|---|---|
| 31,468 A * | 2/1861 | Ludden | A24F 1/26 | 131/181 |
| 265,571 A * | 10/1882 | Bushnell | A24F 1/26 | 131/181 |
| 4,116,204 A * | 9/1978 | Kline | A24F 1/30 | 131/173 |
| 4,164,231 A * | 8/1979 | Greenwald | A24F 13/02 | 131/192 |
| 4,911,181 A * | 3/1990 | Vromen | A24F 47/002 | 131/270 |
| 6,550,727 B2 * | 4/2003 | Butterfield | B62D 1/184 | 248/188.5 |
| 6,883,264 B1 * | 4/2005 | Gimbel | A01K 81/04 | 43/6 |
| 7,415,982 B1 * | 8/2008 | Sheridan | A24F 1/28 | 131/191 |
| 8,162,270 B2 * | 4/2012 | Lee | F16B 7/1427 | 248/157 |
| 8,424,537 B2 * | 4/2013 | Rosenthal | A61M 11/041 | 131/191 |

(Continued)

*Primary Examiner* — Kevin R Kruer

(57) ABSTRACT

The present invention comprises a novel smoking and vaporizing apparatus assembly generally consisting of a storage container (14), a mouthpiece (13) and smoking pipe (12) that slides into the mouthpiece in such way that there is no air can enter the space between the mouthpiece and smoking pipe. Specifically configured frictional resistances of the apparatus allow for seamless collapsing and retraction of the smoking pipe in and out of the mouthpiece, securing the apparatus inside of the storage container without touching the hot smoking pipe, and retracting the apparatus from the lid of the container without retracting the smoking pipe from the mouthpiece. Other embodiments are described and shown.

10 Claims, 7 Drawing Sheets

(56) References Cited

U.S. PATENT DOCUMENTS

| | | | | |
|---|---|---|---|---|
| 9,693,587 | B2 * | 7/2017 | Plojoux | A61M 15/06 |
| 9,925,399 | B1 * | 3/2018 | Goldberg | A62B 33/00 |
| 10,206,425 | B2 * | 2/2019 | Breiwa, III | A24F 47/002 |
| 10,264,817 | B2 * | 4/2019 | Haun | A24F 9/16 |
| 2005/0169814 | A1 * | 8/2005 | Rosenthal | A61M 11/041 422/125 |
| 2007/0034216 | A1 * | 2/2007 | Liu | A24F 13/18 131/256 |
| 2008/0023003 | A1 * | 1/2008 | Rosenthal | A61M 11/041 128/203.26 |
| 2008/0284158 | A1 * | 11/2008 | Lin | A47L 9/244 285/7 |
| 2011/0018257 | A1 * | 1/2011 | Jeon | A47L 9/244 285/303 |
| 2012/0073586 | A1 * | 3/2012 | Shengelia | A24F 1/28 131/185 |
| 2017/0112189 | A1 * | 4/2017 | Stern | A24F 13/06 |
| 2017/0208860 | A1 * | 7/2017 | Evans, II | A24F 1/28 |
| 2018/0110259 | A1 * | 4/2018 | Kartashov | A24F 1/06 |
| 2018/0116278 | A1 * | 5/2018 | Millington | A24F 3/00 |
| 2019/0069600 | A1 * | 3/2019 | Dang | A24F 47/008 |
| 2019/0230996 | A1 * | 8/2019 | Brammer | A24F 47/008 |

* cited by examiner

PORTABLE SMOKING AND VAPORIZING DEVICE ASSEMBLY

CROSS REFERENCES TO RELATED APPLICATIONS

This application claims the benefit of Applicant's prior provisional application No. [62/411,835], filed on Oct. 24, 2016.

FIELD OF THE INVENTION

The present invention relates to a tobacco smoking and vaporizing assembly which comprises a smoking pipe with a mouthpiece and a storage/transporting container. More particularly, the present invention relates to a device, which allows tobacco and essential oils to be smoked, vaporized and safely transported.

BACKGROUND

Many pipe-type smoking and vaporizing articles have been proposed during the recent years, which may include smoking devices of various sizes, shapes, and colors. Such devices allow smokers to burn or vaporize tobacco and essential oils inside of the pipe and inhale the smoke or vapor produced during the process.

Numerous articles address portable smoking pipes and the improvements in the smoke quality. In addition to that, certain number of inventions include novel ways of vaporizing tobacco and essential oils.

However, the aforementioned articles suffer many drawbacks that inconvenience a user of the device. The smoking pipes typically produce a certain tobacco smell that stays with the pipe until cleaned, which makes it uncomfortable for users to carry around. The bigger the pipe, the more smell it will produce after use.

Another drawback is that the aforementioned articles are usually space consuming and require some room in your pocket, as they contain many pieces.

Refilling said articles with loose tobacco could be challenging on the go, especially in high wind situations.

Often times, smoking and vaporizing devices are made of borosilicate glass or infused silica. These materials are very brittle and susceptible to accidental breakage. Such incidents can be costly for the user and can cause further inconvenience.

The pipe itself can absorb heat and become very hot during the process of smoking, which makes it impossible to place in your pocket or touch with bare hands until cooled. Nevertheless, the user of the device often forced to carry a separate container with smoking material inside.

Therefore, a need exists in the field for a novel all-in-one portable smoking and vaporizing device that is capable of producing quality smoke on the go and is easy to load with tobacco. A further need exists for a smell-free article which conceals the smell of a smoking pipe and tobacco inside of the container when not in use. In addition to that, a need of a compact smoking device exists to reduce the cost of the article and replacements and to save room in the user's pocket. Finally, there is a need for a smoking device that is safe to use. The invention should prevent any damages to the skin or property of the user related to heat produced by said device.

BRIEF SUMMARY OF THE INVENTION

The present invention comprises a novel collapsible smoking and vaporizing apparatus and a storage container for said apparatus and smoking material.

Specifically configured frictional resistances of the apparatus allow users to conveniently collapse and retract the smoking pipe in and out of the mouthpiece, secure the pipe inside of the container without touching the hot pipe, and retract the pipe from the lid insert without retracting the smoking pipe from the mouthpiece.

BRIEF SUMMARY OF THE DRAWINGS

Some embodiments of the present invention are illustrated as an example and are not limited by the figures of the accompanied drawings, in which like references may indicate similar elements and in which.

DETAILED DESCRIPTION OF THE INVENTION

The terminology used herein is for the purpose of describing embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context cicarly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New smoking assembly devices, apparatuses, and methods for consuming tobacco and essential oils are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
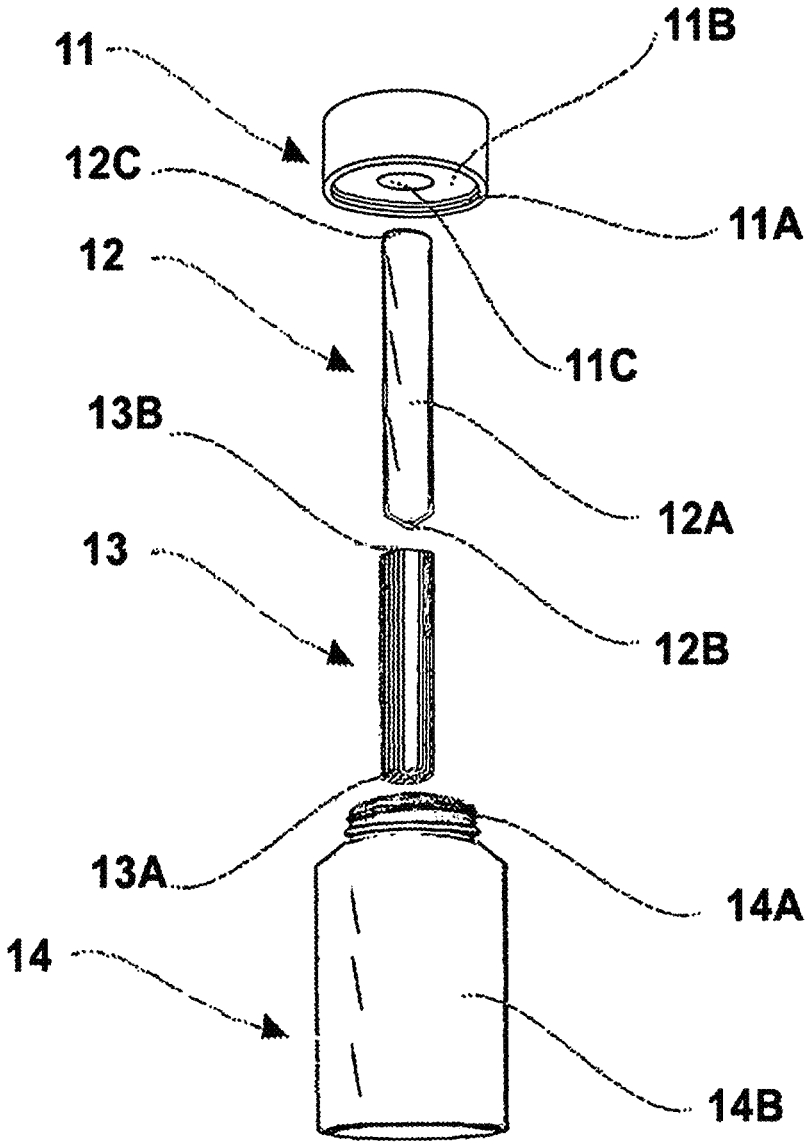
FIG. 1—FIG. 1 depicts an exploded perspective view of one example of the smoking and vaporizing device assembly according to various embodiments of the present invention.

The present invention will now be described by the appended figures representing various embodiments. FIG. 1 depicts an exploded perspective view of the elements that may comprise a smoking and vaporizing assembly (the "Device") according to various embodiments of the present invention. In the first embodiments, the aperture 11C of the lid insert 11B is configured to accept the smoking pipe 12.

The lid insert 11B along with a smoking pipe 12 are unthreaded. In the first embodiments, the lid insert is made of wood and has an aperture of 6.99 mm. In the second embodiments as shown in the FIG. 6C, the lid insert 11B is made from the silica gel with the shore A hardness of 50 to achieve a proper frictional resistance between the pipe 12 and the lid insert 11B, described later in this publication. Also, in the second embodiments the aperture of the lid insert 11B is configured to 7.98 mm.

The lid insert 11B may be made of, hydrogenated nitrile butadiene rubber, silica gel, acrylonitrile butadiene rubber, polysiloxane, fluorocarbon, or other similar or suitable materials, which may have high heat resistance.

Figure 6A:
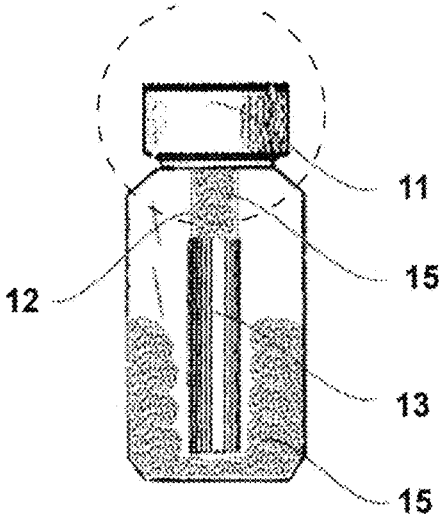
FIG. 6A—FIG. 6A illustrates a side view of a smoking and vaporizing device assembly according to various embodiments described herein.
Figure 6B:
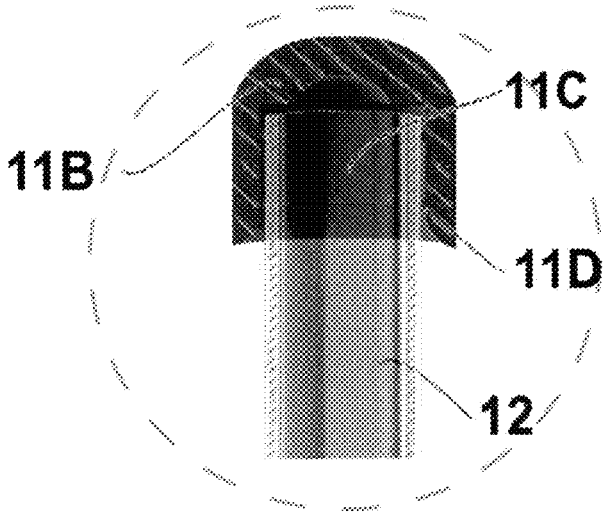
FIG. 6B—FIG. 6B shows a partial sectional view of the smoking and vaporizing device assembly according to various embodiments described herein.
Figure 6C:
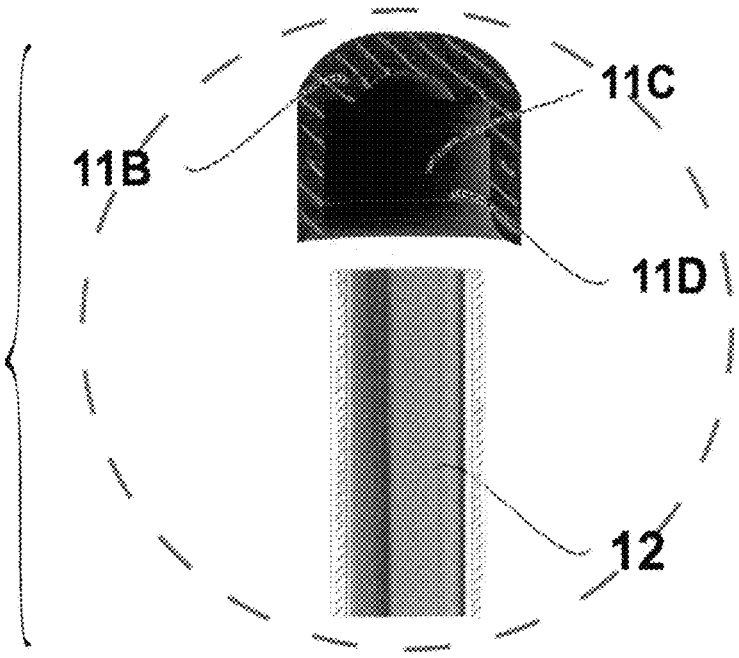
FIG. 6C—FIG. 6C shows a partial sectional exploded view of the smoking and vaporizing device assembly according to various embodiments described herein.

As shown in the FIG. 6C, the lid insert 11B may have at least one ridge 11D with a preconfigured height, width, length and hardness. In the second embodiments, the lid insert 11B has 2 identical ridges configured to 0.5 mm height, 0.8 mm width, and a length that equals the full circumference of the inner diameter of the lid insert 11B. In the second embodiments, the ridges have a shore A hardness of 50. This allows a desired frictional resistance to be configured between the smoking pipe 12 and the lid insert 11B as described later in this publication.

The lid 11 comprises a thread 11A configured to accept the thread 14A. When the lid 11 is affixed to the container 14, the lid insert 11B is in the close contact with the surface of the thread 14A, so that the container 14 is perfectly sealed, therefore no air can enter or escape the container 14. This helps to conceal the smell of the smoking pipe 12 and the smoking material 15 inside of the container 14 and also makes the container waterproof.

Figure 3A:
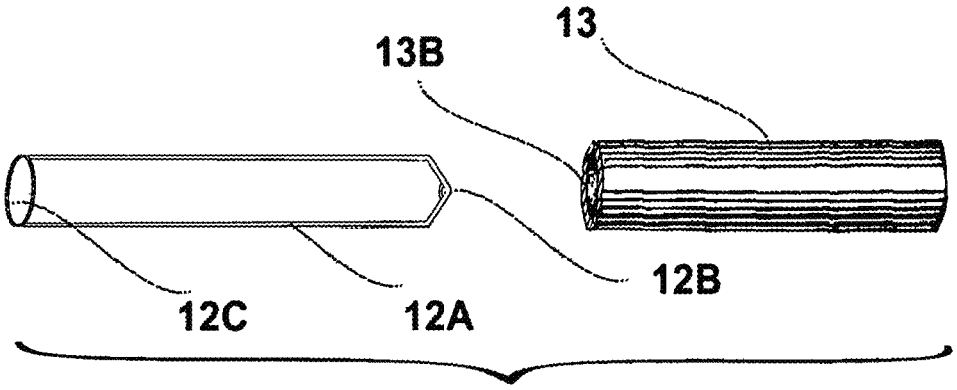
FIG. 3A—FIG. 3A shows an exploded perspective view of the smoking and vaporizing apparatus according to various embodiments described herein.
Figure 4A:
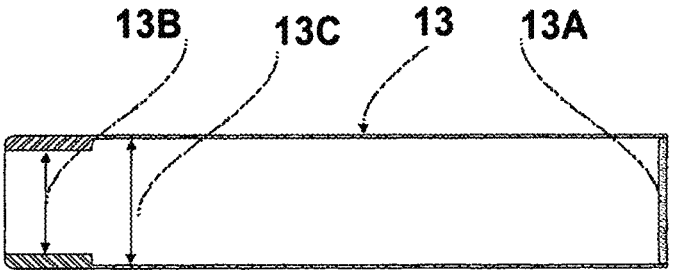
FIG. 4A—FIG. 4A shows a sectional view of the mouthpiece according to various embodiments described herein.

In the first embodiments, the mouthpiece 13 has an aperture 13B that is illustrated in the FIGS. 3A and 4A. The aperture 13B is configured to accept the pipe 12 in such way that the pipe can slide tightly inside of the mouthpiece 13. In various embodiments, either end of the smoking pipe 12 can go inside of the mouthpiece 13. The mouthpiece may be made of carbon fiber, fluoropolymer, steel, aluminum, wood, or any other similar or suitable material that has a high temperature tolerance. In the first embodiments illustrated in the FIG. 3A the mouthpiece is made of titanium. In the second embodiments shown in the FIG. 5B the mouthpiece is made of the aircraft grade aluminum 6061 T6. In the second embodiments, the aircraft grade aluminum was found to be beneficial in cooling down the smoke because of its heat transfer and thermal capacity properties, providing with a better user experience.

In the first embodiments shown in FIG. 4A, the aperture 13B is configured in such way that it is smaller than the aperture 13C. This is done in order to achieve a constant coefficient of frictional resistance between the pipe 12 and mouthpiece 13, so that the resin and ashes accumulated on the inner walls of the mouthpiece 13 as a result of smoking don't change said coefficient of frictional resistance. In the first embodiments the aperture 13B was configured to 7.02 mm and the aperture 13C was configured to 9 mm. In the second embodiments shown in the FIG. 5B the aperture 13B was configured to 8.05 mm and the aperture 13C of the FIG. 4A to 10 mm.

Figure 5A:
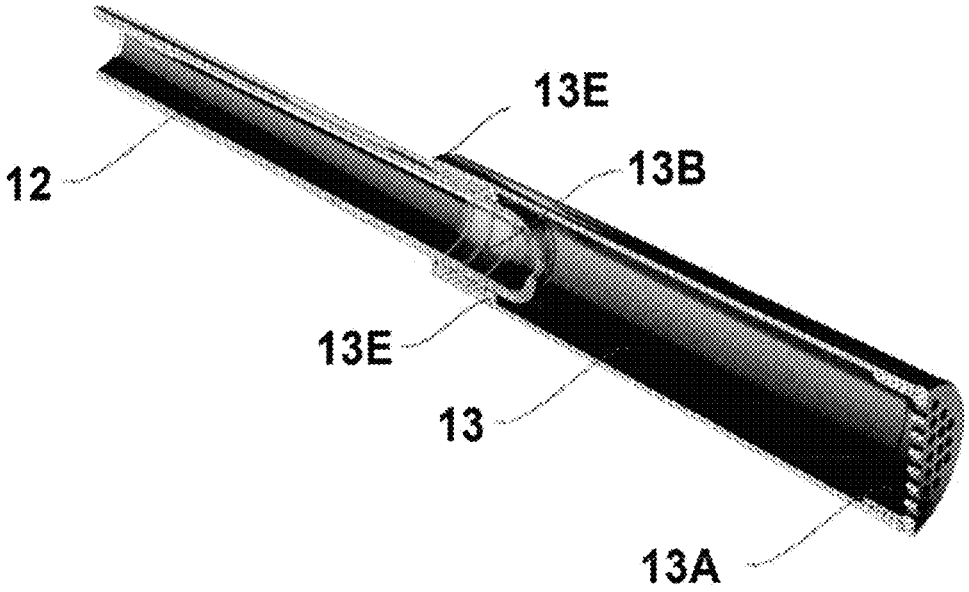
FIG. 5A—FIG. 5A shows a sectional view of the smoking and vaporizing apparatus according to various embodiments described herein.
Figure 5B:
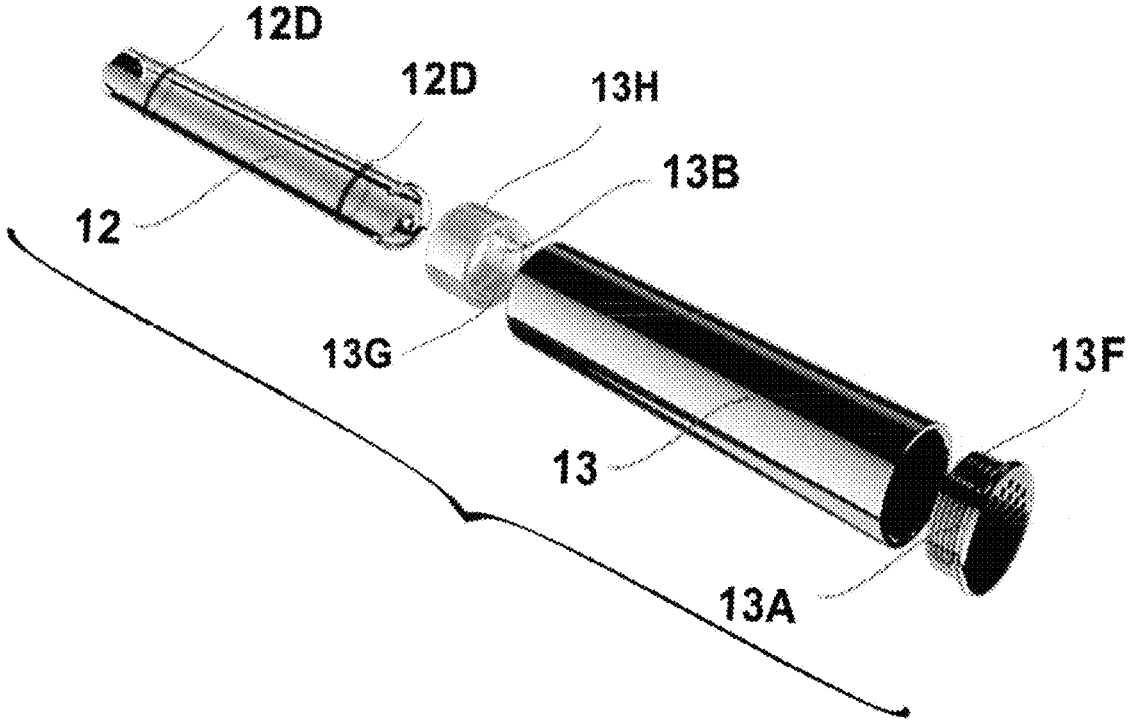
FIG. 5B—FIG. 5B shows an exploded view of the smoking and vaporizing apparatus according to various embodiments described herein.

In the second embodiments as shown in the FIG. 5B, the mouthpiece 13 may have at least two internal ridges 13E with a predetermined height and length. The ridges 13E secure the mouthpiece insert 13H inside of the mouthpiece 13. In the second embodiments, two identical ridges are configured to have 0.5 mm height and a length that equals to the full circumference of the inner diameter of the mouthpiece 13.

The aperture 13B may be configured by using a special insert, therefore it's not necessarily made of the same material as the mouthpiece 13. In the first embodiments illustrated in the FIG. 4, the aperture 13B is configured using the same material as the mouthpiece 13. One of the biggest challenges of configuring the apertures is the tolerance limitations of today's factories. In the first embodiments, a tolerance of 0.01 mm or lower on both the mouthpiece and smoking pipe was required to properly configure the apertures to allow for a smooth smoking pipe movement inside of the mouthpiece. For the purpose of this publication, we consider the smooth pipe movement to be a minimum effort required to collapse and extend the smoking and vaporizing apparatus using an average human's hands without applying any extraordinary force. In addition to that, low tolerances are required to ensure that no air can enter between the aperture 13B and the smoking pipe 12, when said smoking pipe is affixed to the mouthpiece.

In the second embodiments shown in the FIG. 5, the aperture 13B is configured using a mouthpiece insert 13H. In the second embodiments the mouthpiece insert 13H is made of the high temperature silica gel with a shore A hardness of 60, which was found to be suitable for a smooth pipe movement. In the third embodiments, the mouthpiece insert 13H is made of the high temperature medical grade silicone with a shore A hardness 70, which requires a tolerance of 0.02 mm on both the smoking pipe 12 and the silicone.

The mouthpiece insert 13H may also be made of hydrogenated nitrile butadiene rubber, silica gel, acrylonitrile butadiene rubber, polysiloxane, fluorocarbon, or other similar or suitable materials, which may have high heat resistance.

In the second embodiments shown in the FIG. 5B, the mouthpiece insert 13H may have at least one ridge 13G with a predetermined height. In the second embodiments three identical ridges 13G were configured with the height of 0.3 mm to ensure the proper configuration of the frictional resistance between the mouthpiece 13 and the smoking pipe 12. In the second embodiments the ridges 13G were also configured to accept the grooves 12D of the smoking pipe 12, as shown in the FIG. 5B and described later in this publication.

The mouthpiece 13 may also have a screen or mesh 13A with at least one opening. The mouthpiece screen 13A can be attached to another end of said mouthpiece or be an integral part of said mouthpiece. The mouthpiece screen plays an important role of preventing any accidental inhaling of the smoking material and ashes. Both ends of the mouthpiece 13 may come apart for easy cleaning. In the first embodiment depicted in the FIG. 3B the mouthpiece screen is made of stainless steel mesh with the mesh size 40. In various embodiments the screen 13A can be made of the same material as the mouthpiece 13 or can be an inseparable part of said mouthpiece. In the second embodiments shown in FIG. 5A the screen 13A is made of the aircraft grade aluminum 6061 T6, which was found to be beneficial in cooling down the smoke because of its heat transfer and thermal capacity properties, providing with a better user experience.

The screen or mesh may also be made of titanium, stainless steel, brass, other metal alloys or polymers, or any other similar or suitable material.

In the second embodiments shown in the FIG. 5B, the mouthpiece 13 and mouthpiece screen 13A both may have threads 13F configured to accept each other. This was found to be beneficial and convenient for the user to clean the screen 13A. In addition to that, in the second embodiments the mouthpiece screen has 37 openings with an inner diameter of 0.8 mm.

In various embodiments, the aperture 13B may be configured in such way that the frictional resistance of the smoking pipe 12 and mouthpiece 13 is greater than the frictional resistance of the pipe 12 and the lid insert 11B. In other words, the pipe 12 may slide in and out of the mouthpiece 13 with a greater resistance than it may slide in and out of the lid insert 11B. As shown in the FIG. 3C, pulling the mouthpiece 13 attached to the pipe 12 depicted in the FIG. 3C in the opposite of the lid 11 direction should result in releasing the pipe 12 together with a mouthpiece 13 from the lid insert 11B, although the pipe 12 should stay inside of the mouthpiece 13. This is an essential part of the operation of the smoking and vaporizing assembly, which eliminates a few extra steps a user would have taken otherwise in order to get the apparatus ready to use. If the mouthpiece 13 simply separated from the pipe 12 when pulled in the opposite direction of the lid 11, the user would have also had to pull the pipe 12 out of the lid insert 11B separately and only then assemble the apparatus, which would cause additional inconvenience.

Figure 4B:
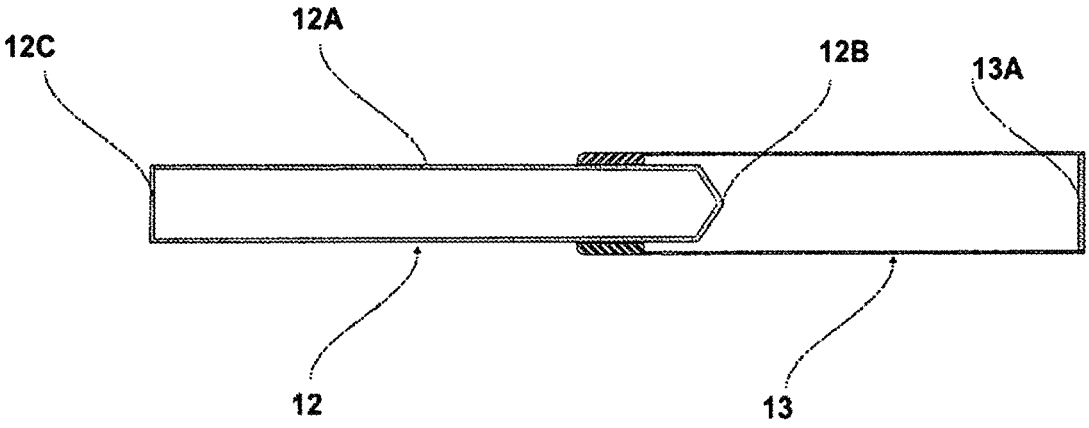
FIG. 4B—FIG. 4B shows a sectional view of the smoking pipe attached to the mouthpiece according to various embodiments described herein.

In the first embodiments as shown in the FIG. 4B, the smoking pipe 12 may be made with thin walls 12A, where one side of the pipe 12C is completely open to allow for loading of the smoking material 15, as illustrated in the FIG. 3A. The other end 12B has a predetermined aperture of the smallest piece of the smoking material used or a predetermined aperture for the desired flow of the vapor. The aperture 12B may be smaller than a size of a single piece of smoking material 15 to prevent the smoking material from entering the body of the mouthpiece 13.

In the first embodiments as shown in the FIG. 4B, the smoking pipe 12 has a 7 mm outer diameter and 55 mm length. The walls 12A are 1 mm thick and the aperture 12B is configured to 1.2 mm. In the first embodiments the pipe 12 is made of titanium or borosilicate glass. One of the biggest disadvantages of these materials found were unacceptable tolerances and inability to standardize the production process. To provide an example, the borosilicate tubing normally has 0.15 mm tolerance which in most cases is not acceptable without utilizing a special matching algorithm of the mouthpiece insert 13H and the outer diameter of the pipe 12. A various methods and algorithms of matching the aperture 13B and the diameter of the smoking pipe 12 can be utilized to configure the desired frictional resistance, which go beyond the scope of this publication. The desired precision found is 0.01 mm which is also a desired tolerance for the first embodiments.

In the second embodiments as shown in the FIG. 5B, the smoking pipe 12 has an outer diameter of 8 mm and 65 mm length. The walls of the smoking pipe 12A are 0.95 mm thick and the aperture 12B is configured to 2 mm. It was found that a predetermined configuration of the outer diameter of the smoking pipe 12, wall thickness 12A, and the aperture 12B is important for device to function properly. In the second embodiments, the pipe 12 is made of infused silica or quartz, which has a 0.01 mm tolerance. Infused silica or quartz is capable of withstanding extremely high temperatures beyond 3,000 F and has a very low coefficient of thermal expansion, which is perfectly suitable for such application.

The smoking pipe may also be made of steel, iron, wood, or any other similar or suitable material that has a high temperature tolerance.

In the second embodiments as shown in the FIG. 5B, the smoking pipe 12 may have at least one groove 12D with a preconfigured width, depth, and length. The groove 12D may serve as an assembly guide for the user, may help securing the pipe 12 inside of the mouthpiece 13, or may serve any other suitable function. In the second embodiments two full circle grooves 12D were configured on the smoking pipe 12 with a 1.1 mm width and 0.25 mm depth. The grooves 12D were configured to accept a ridge 13G of the mouthpiece insert 13H. The distance from the open ended side 12C of the pipe 12 to the edge of the groove 12D was configured to 7.7 mm and the distance from the side 12B to the edge of the groove 12D was configured to 9.5 mm. Such mechanism servers as a detent, preventing the pipe 12 from falling out of the mouthpiece 13 when the user flicks of the ash using the shaking motion. In addition, the groove 12D provides an inserting guidance for the user.

Figure 2:
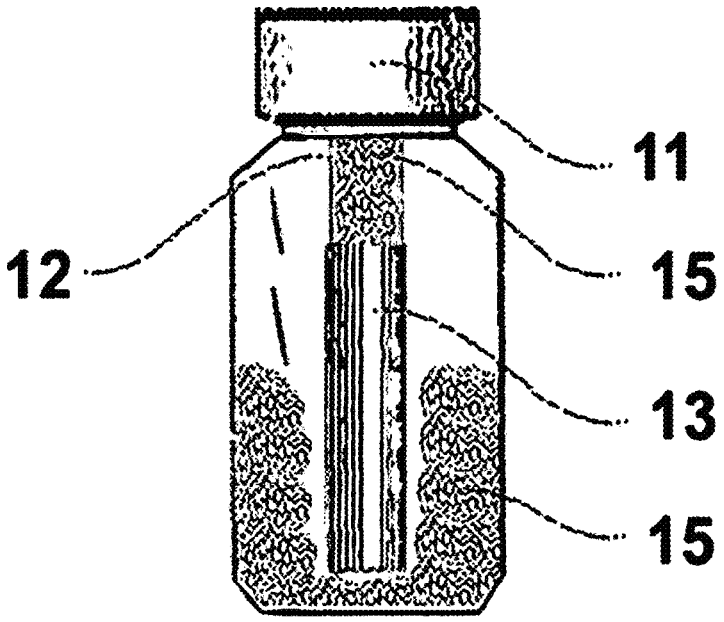
FIG. 2—FIG. 2 illustrates a side view of a smoking and vaporizing device assembly according to various embodiments described herein.

In the various embodiments, the container 14 has thin walls 14B and may be in the form of a rounded bottle, cube, pyramid, rhomboid, rectangular prism or any other similar or suitable form. As shown in the FIG. 2, the container 14 may also include room inside for storing the smoking material 15.

Figure 3B:
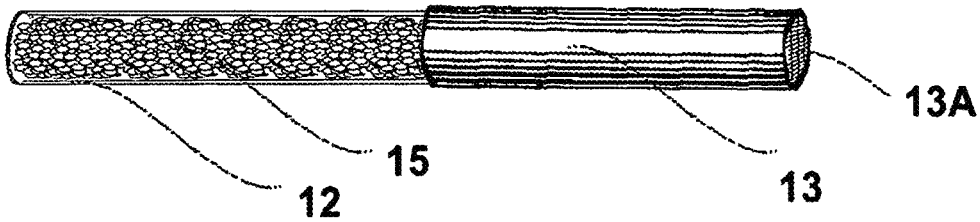
FIG. 3B—FIG. 3B shows an assembled smoking and vaporizing apparatus according to various embodiments described herein.
Figure 3C:
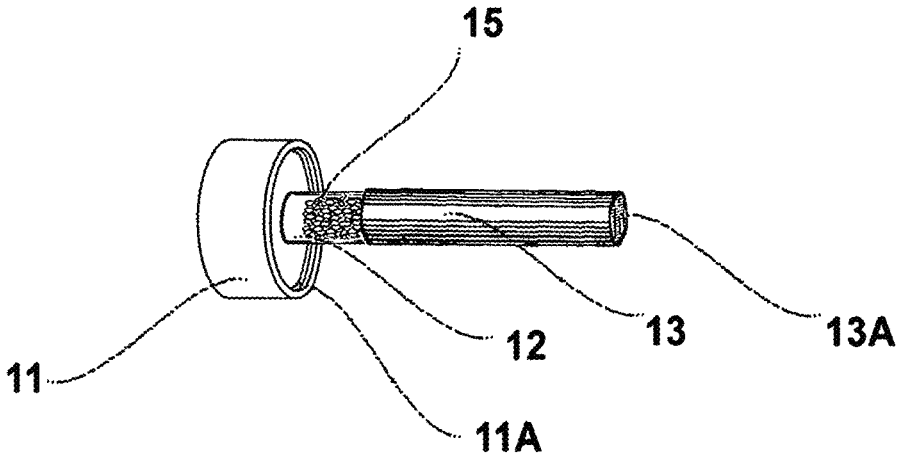
FIG. 3C—FIG. 3C shows a collapsed apparatus inserted into a lid insert of the container according to various embodiments described herein.

There are several ways of filling and refilling the smoking pipe 12 with the smoking material 15. The FIG. 3B illustrates the smoking and vaporizing apparatus assembly, wherein the depicted position of the smoking pipe 12 allows for rapid refills of said smoking pipe by using one's respiratory system. In other words, a user can refill the smoking chamber of the smoking pipe 12 by sucking the ground smoking material through the mouthpiece using his or her mouth. The predetermined aperture 12B as shown in FIG. 4B prevents the ground smoking material 15 from entering the mouthpiece. In this case, the smoking pipe 12 should be positioned with the side 12B towards the mouthpiece.

Other methods may include, but not limited to, filling the smoking pipe 12 using a poker or any other suitable method.

The FIG. 3B. and FIG. 4B. show a possible smoking pipe 12 position for smoking of loose leaf tobacco products. Upon igniting the tip of smoking pipe 12 with a lighter or hemp wick, the smoking material 15 inside of the pipe 12 burns evenly, producing a clean smoke for the user. The pipe 12 only burns the tobacco while the user inhales, which requires periodic ignition of the smoking material 15. As a result, the unique thermodynamics of the smoking and vaporizing apparatus allow users to save more of their precious smoking material compare to some similar devices in the field.

Just like any other combustion pipe, the pipe 12 may warm up as a result of the smoking. To prevent injuries and property damage from heat, the user should only hold and touch the mouthpiece 13 and not the pipe 12 during and after smoking until the pipe 12 has cooled. Upon finishing smoking, the hot pipe 12 can be inserted directly into the lid insert 11B with a help of the mouthpiece 13 as shown in the FIG. 3C. The smoking and vaporizing apparatus can be collapsed for storage and lid 11 can be attached to the container 14 for storage and transporting. Following this simple procedure, the physical contact with the pipe 13 can be completely avoided.

Figure 4C:
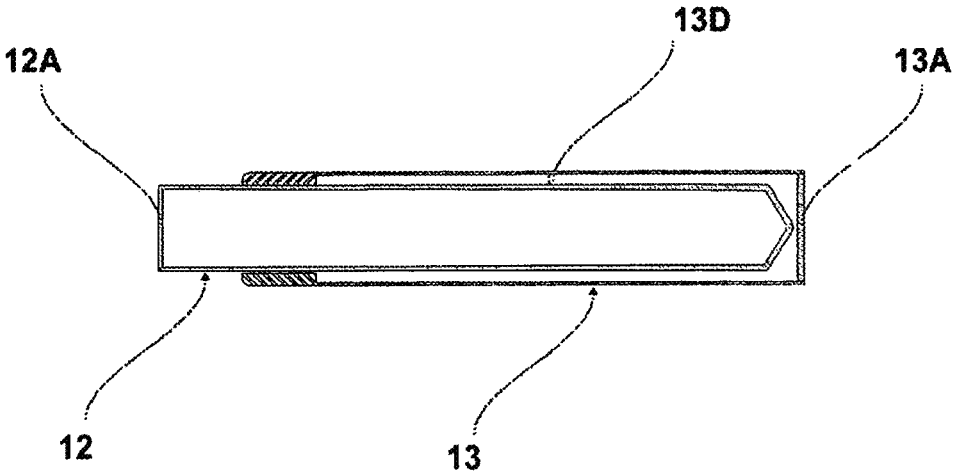
FIG. 4C—FIG. 4C shows a sectional view of the smoking pipe collapsed inside of the mouthpiece according to various embodiments described herein.

The smoking pipe 12 collapsed into the mouthpiece 13 is also shown in a cutaway view in the FIG. 4C. The distance 13D between the pipe 12 and inner walls of the mouthpiece 13 is created as a result of the difference in the apertures 13B and 13C. The empty space 13D is used to accommodate the resin and ashes accumulated on the inner walls of the mouthpiece 13 as a result of smoking.

In the various embodiments, the mouthpiece 13 may be attached to either end of the smoking pipe 12. When smoking tobacco products, the user can periodically shake the article to release the ash from the smoking pipe 12. When the flame gets close to the end of the smoking pipe 12B, the user can flip the smoking pipe 12, positioning it as shown in the FIG. 7 and continue smoking from the other side. As a result, the combustion will occur as far away from the user's face as possible. It is important to note that the user should allow the pipe 12 to cool down before touching it with bare hands.

Figure 7:
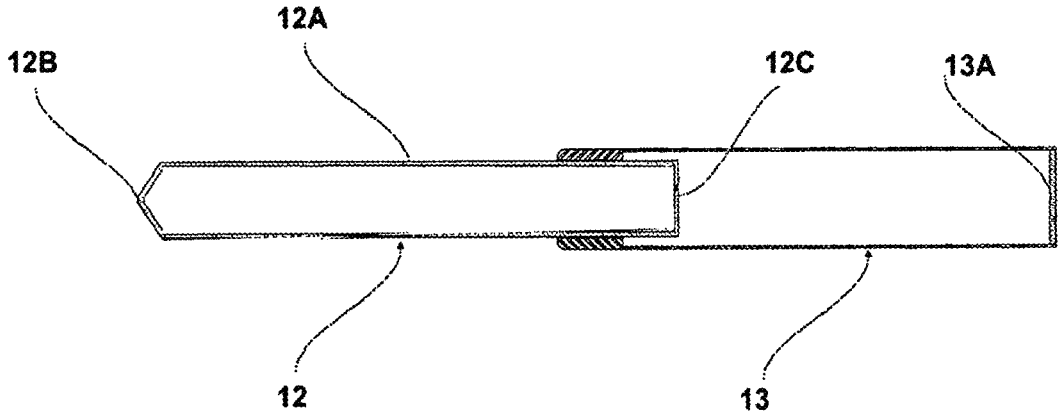
FIG. 7—FIG. 7 shows a sectional view of the smoking and vaporizing apparatus with an alternative smoking pipe positioning according to various embodiments described herein.

To vaporize the essential oils and concentrates, one can position the smoking pipe 12 as shown in the FIG. 7. The tip 12B can be heated with a blowtorch and then touched against the essential oil or concentrate. This will produce an instant vapor which can be inhaled by the user.

The smoking pipe 12 can be refilled with smoking material multiple times before it requires a cleaning. In addition to that, the smoking pipes 12 can be interchanged to suit for the various needs of the user, such as using different smoking pipes 12 for different tobacco flavors.

ADVANTAGES

From the description above, a number of advantages of some embodiments of my smoking and vaporizing assembly become evident:

a) The tobacco inside of the smoking pipe only burns while the user inhales, which makes the apparatus very efficient. There is very little to no waste of the smoking material, which sometimes can be expensive. This is particularly important on the go.

b) The collapsible design makes the pipe as twice as short as some of the existing models, which saves room in pockets and bags.

c) The waterproof and smell-proof design protects the user's tobacco and smoking pipe on the go, while keeping the pockets and bags free of smell d) The supply of the ground smoking material can be stored in the same container along with the collapsed pipe for convenient on the go refills, which makes it a complete device for all on the go smoking needs.

e) The inhaling refill method is a convenient way to recharge the smoking pipe on the go without unnecessary complications.

f) Interchangeable smoking pipes will make it possible to consume different flavors of tobacco without having to empty the smoking pipe every time to load a new flavor.

g) Interchangeable smoking pipes and the low cost of their production will make it easy and affordable to get replacements.

h) Same device can be used to vaporize essential oils and concentrates.

i) Inserting the hot smoking pipe directly inside of the lid of the container with the help of the mouthpiece and collapsing the article by holding the mouthpiece only will prevent injuries and property damage.

While the materials for elements have been described, the device is not limited by these materials. Wood, plastics, rubber, foam, metal alloys, aluminum, and other materials may comprise some or all of the elements of the smoking devices and apparatuses in various embodiments of the present invention.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art without departing from the spirit of this invention.

What is claimed is:

1. A smoking and vaporizing assembly comprising:

a. a smoking pipe with one open end and one tapered end b. a mouthpiece that accepts said smoking pipe and has a frictional resistance with said smoking pipe which allows for collapsing and retraction of said smoking pipe in and out of said mouthpiece such that no air can enter the space between said mouthpiece and said smoking pipe;

c. a mouthpiece screen with at least one opening, d. a container that accepts said smoking pipe and mouthpiece along with smoking material; and e. a lid for said container with an aperture which accepts said smoking pipe and wherein said lid further includes a lid insert comprising at least one ridge and an aperture which accepts said smoking pipe and wherein said lid insert has a frictional resistance with said smoking pipe which is less than the frictional resistance between said smoking pipe and said mouthpiece.

2. The smoking and vaporizing assembly of claim 1 wherein said smoking pipe further includes at least one groove.

3. The smoking and vaporizing assembly of claim 1 wherein said mouthpiece further includes a mouthpiece insert that accepts said smoking pipe and has said frictional resistance with said smoking pipe.

4. The smoking and vaporizing assembly of claim 3 wherein said mouthpiece insert further includes at least one ridge to ensure said frictional resistance between said mouthpiece insert and said smoking pipe.

5. The smoking and vaporizing assembly of claim 1 wherein said mouthpiece further includes at least two internal ridges on opposite sides of said mouthpiece insert.

6. The smoking and vaporizing assembly of claim 1 wherein said mouthpiece screen further includes a thread and is detachable from said mouthpiece.

7. The smoking and vaporizing assembly of claim 6 wherein said mouthpiece further includes a thread configured to accept said mouthpiece screen.

8. A smoking and vaporizing apparatus comprising:

a. a smoking pipe comprising one open end, one tapered end, and at least one groove;

b. a mouthpiece that accepts said smoking pipe wherein said mouthpiece includes a mouthpiece insert which is secured inside said mouthpiece by two ridges located on said mouthpiece such that said two ridges are located on opposite sides of said mouthpiece insert; said mouthpiece insert comprises at least one ridge that engages with said groove of said smoking pipe and has a predetermined frictional resistance with said smoking pipe such that no air can enter the space between said mouthpiece and said smoking pipe and which allows for collapsing and retraction of said smoking pipe in and out of said mouthpiece; and c. a mouthpiece screen with at least one opening.

9. The smoking and vaporizing apparatus of claim 8 wherein said mouthpiece screen further includes a thread and is detachable from said mouthpiece.

10. The smoking and vaporizing apparatus of claim 9 wherein said mouthpiece further includes a thread configured to accept said mouthpiece screen.

* * * * *